United States Patent [19]

Hannemann

[11] 4,258,637

[45] Mar. 31, 1981

[54] MOVABLE WORKPIECE-CLAMPING ATTACHMENT FOR SEWING MACHINE

[75] Inventor: Franz Hannemann, Detmold, Fed. Rep. of Germany

[73] Assignee: Durkoppwerke GmbH, Bielefeld, Fed. Rep. of Germany

[21] Appl. No.: 13,076

[22] Filed: Feb. 21, 1979

[30] Foreign Application Priority Data

Feb. 24, 1978 [DE] Fed. Rep. of Germany ..... 2807895

[51] Int. Cl.[3] ..... D05B 21/00

[52] U.S. Cl. ..... 112/121.26; 112/311; 269/27

[58] Field of Search ..... 112/121.26, 121.12, 112/121.15, 121.27, 311, 148, DIG. 2, DIG. 3; 269/27, 56, 25, 20, 24; 198/859, 832, 486; 226/144, 145; 271/230

[56] References Cited

U.S. PATENT DOCUMENTS

| | | | |
|---|---|---|---|
| 3,658,315 | 4/1972 | Boucherie | 269/56 X |
| 4,066,026 | 1/1978 | Hunt | 112/121.15 |
| 4,102,280 | 7/1978 | Hannemann | 112/121.26 |
| 4,104,977 | 8/1978 | Pollmeier et al. | 112/121.26 |

*Primary Examiner*—Werner H. Schroeder
*Assistant Examiner*—Andrew M. Falik
*Attorney, Agent, or Firm*—Karl F. Ross

[57] ABSTRACT

To grip the tail end of a workpiece such as a stack of fabric layers to be stitched in a sewing machine, a pneumatically actuatable clamp on a carriage reciprocably guided along a rail has an air inlet in the form of a first nipple with a lateral entrance aperture confronting a discharge opening of a stationary air-supply line when the clamp is in a retracted loading position remote from the sewing machine. Air admitted in that position to a pressure cylinder via a branch of the supply line forces the inlet duct of the clamp against a sealing ring surrounding the discharge opening to conduct the main air flow via a check valve and a control valve to an operating jack for closing the clamp, the jack including a single-acting spring-loaded piston. After the air supply has been cut off, the front end of the workpiece is engaged by the sewing-machine feed whereby the carriage is entrained toward an unloading position against a counteracting force while the air pressure is maintained by the check valve to hold the clamp closed. In the unloading position, proximal to the sewing machine, the control valve is reversed by an end stop to vent the cylinder of the operating jack whereby the clamp is opened to release the workpiece whereupon the counteracting force returns the carriage to the loading position in which another end stop sets the control valve to its original state.

11 Claims, 3 Drawing Figures

MOVABLE WORKPIECE-CLAMPING ATTACHMENT FOR SEWING MACHINE

FIELD OF THE INVENTION

My present invention relates to a device, actuatable by compressed air or some other pressure fluid, for releasably clamping a workpiece moving along a predetermined path between two stations, i.e. a first station where the workpiece is engaged and a second station where it is released.

BACKGROUND OF THE INVENTION

Commonly owned U.S. Pat. Nos. 4,102,280 and 4,104,977 disclose and claim devices of this type designed to hold a workpiece, such as a stack of fabric layers to be stitched together along a linear seam, under a certain tension during transportation of that workpiece under a pressure foot of a sewing machine. The device comprises a trailing clamp reciprocable between a loading position and an unloading position, the clamp being entrained toward the unloading position by the engaged workpiece and being returned to its loading position by a counteracting force after releasing that workpiece.

According to U.S. Pat. No. 4,104,977, the counteracting force is provided by a weight; U.S. Pat. No. 4,102,280 discloses means for varying the counteracting force between a low value during forward motion and a high value during the return stroke, e.g. with the aid of a turbine driven by an air stream.

In systems of this type, wherein the workpiece is gripped by a moving clamp which is fluidically operated, the activating fluid must be supplied to the clamp-supporting carriage through a flexible conduit capable of following the movement of that carriage. Rubber hoses or the like used for this purpose have only a limited service life as they tend to fatigue upon repeated flexing and unflexing. Their elasticity varies with temperature and gives rise to unpredictable forces acting upon the clamp carriage, particularly when hoses are bent with a small radius of curvature. Finally, the loop formed by such a hose in certain carriage positions may interfere with the mobility of the operator and could also lead to entanglement with extraneous objects, particularly in a large plant comprising a multiplicity of closely juxtaposed sewing stations or the like.

Similar problems arise with fluid-actuated mobile clamps which are not entrained by the engaged workpiece but, on the contrary, are used to displace that workpiece over a predetermined path.

OBJECTS OF THE INVENTION

The general object of my present invention is to provide means for supplying an operating fluid under pressure to a mobile clamp in a predetermined loading position of its carriage without the use of flexible conduits between the source of pressure fluid and the carriage.

A related object is to provide means for holding such a clamp closed against a biasing force while the carriage, disconnected from the source of pressure fluid, moves from its loading position to a remote unloading position.

SUMMARY OF THE INVENTION

In accordance with an important feature of my invention, a clamp mounted on a carriage guided along a track between two stations is provided with fluidically actuatable operating means, such as a pneumatic jack, having an inlet channel which communicates with a source of pressure fluid in a loading position at the first of these stations so that the clamp is closed against a biasing force by the admitted pressure fluid. The inlet channel is provided with valve means settable in the loading position to maintain the pressure of the admitted fluid, the valve means including a control valve which is reversible in an unloading position at the second station to relieve the fluid pressure and allow the clamp to release.

Pursuant to another feature of my invention, a station at one end of a guide track for a clamp carriage is provided with a stationary socket which forms a discharge opening connected via a supply line to a source of pressure fluid, the clamp-operating means having an inlet channel receivable in the socket so that an entrance end of this channel confronts the aforementioned discharge opening. When the source is activated, as by the opening of a normally closed shut-off valve, a plunger located at the socket—preferably a piston fluidically operated from the same source—forces the entrance end of the inlet channel into fluidtight contact with the confronting discharge opening to pressurize the clamp-operating means. Advantageously, the channel entrance is a lateral aperture of a nipple extending in the direction of carriage motion, the nipple moving past the sealing ring at close distance therefrom as the carriage enters and leaves its loading position. Such a nipple can be brought into contact with the socket wall by a minor deflection transverse to its direction of motion.

BRIEF DESCRIPTION OF THE DRAWING

The above and other features of my invention will now be described in detail with reference to the accompanying drawing in which.

SPECIFIC DESCRIPTION

Figure 1:
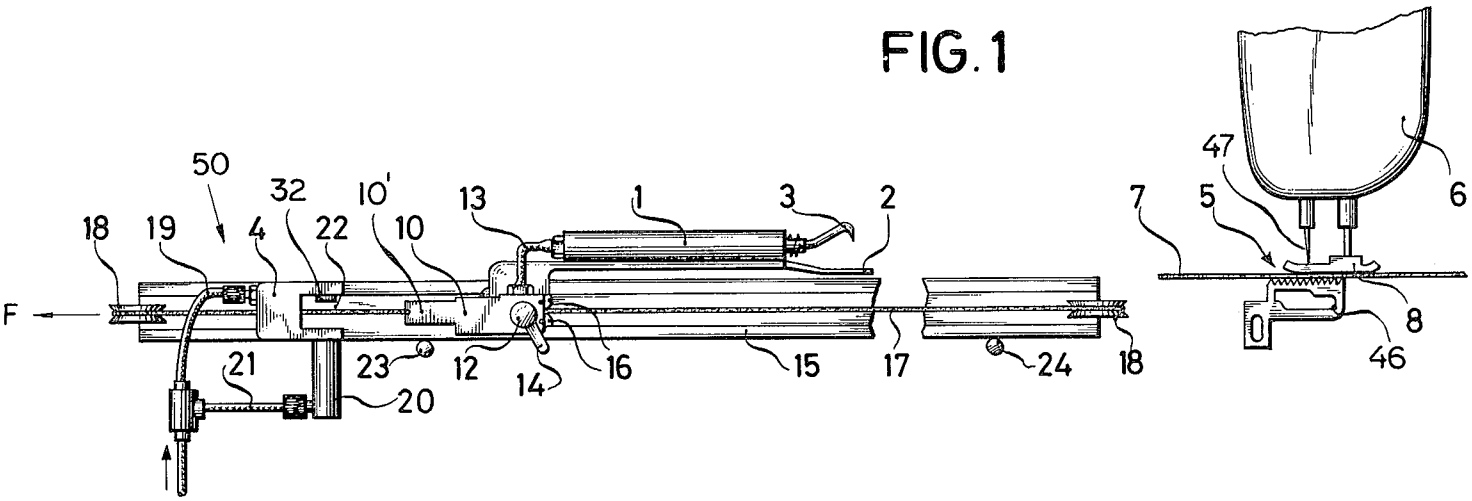
FIG. 1 is a side-elevational view of a workpiece-gripping device according to my invention.
Figure 2:
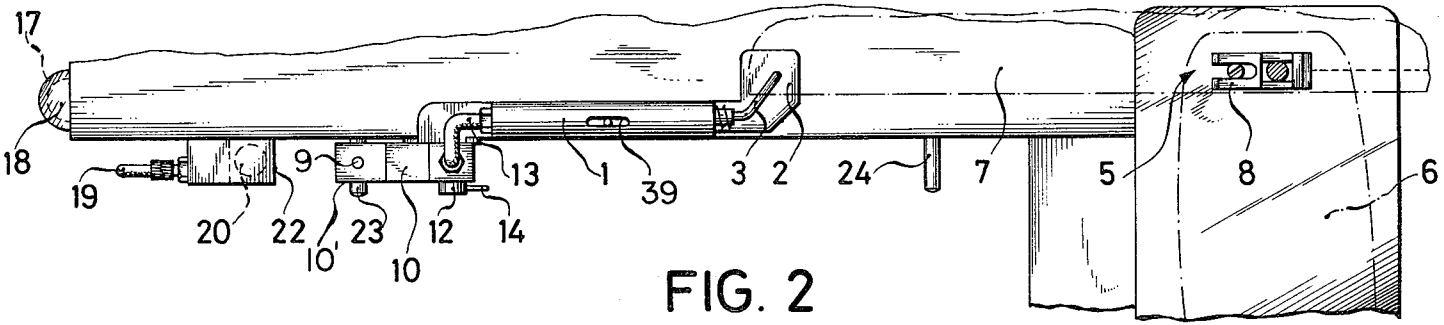
FIG. 2 is a plan view of the assembly shown in FIG. 1.

In FIGS. 1 and 2 I have shown a work station 5 comprising a sewing machine 6 with the usual presser foot 8 and fabric feed 46 serving to advance a workpiece 7 past its needle 47 for the purpose of forming a seam. The workpiece 7 is an elongate stack of fabric layers to be stitched together, e.g. to form a sleeve for a trouser leg, as it moves from left to right below the presser foot 8 on a nonillustrated work table. During this movement, the tail end of the workpiece is gripped by jaws 2, 3 of a trailing or drag clamp comprising a pneumatic jack 1 for the operation of the jaws. The clamp 1–3 is supported on a carriage 10 with rollers 16 which are guided in a track 15 for reciprocation between work station 5 and another station 50 remote from sewing machine 6.

Carriage 10 is engaged by a cable 17 which passes around rollers 18 and is subjected to a unidirectional force F tending to pull the carriage together with clamp 1–3 toward station 50, thus holding the engaged workpiece 7 under tension. The cable preferably forms an endless loop, as described in commonly owned U.S. Pat. No. 4,102,280, and is biased by a turbine or similar driving unit allowing the force F to be varied between a lower level during forward motion and a higher level during the return stroke, as likewise described in that prior patent. In principle, however, force F could also be provided by a weight as shown in commonly owned U.S. Pat. No. 4,104,977.

Figure 3:
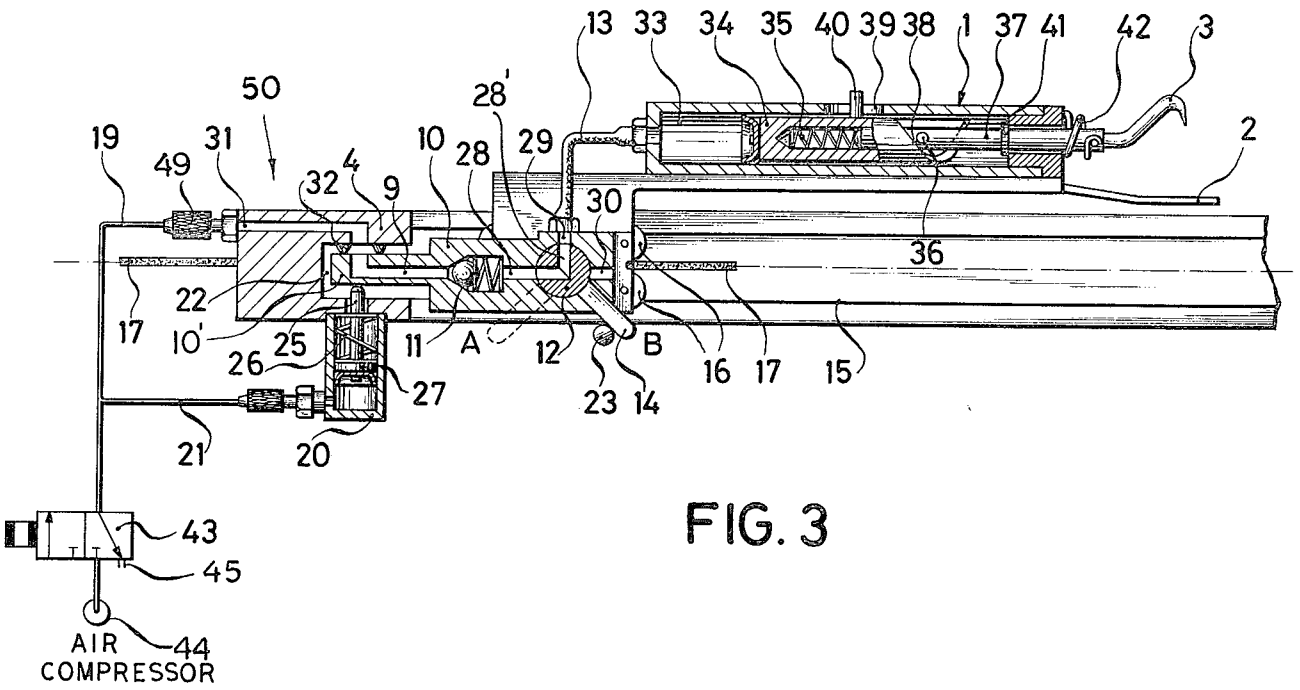
FIG. 3 is a sectional detail view of the left-hand portion of FIG. 1, drawn to a larger scale.

Station 50 at the left-hand end of track 15 comprises a block 4 which forms a socket 22 accommodating an extension 10' of carriage 10 when that carriage is in a loading position remote from sewing machine 6. Carriage extension 10' is a flat nipple of substantially rectangular cross-section whose upper surface (as best seen in FIG. 3) is closely overlain in the loading position by the upper wall of socket 22, with interposition of a preferably elastic sealing ring 32 secured to that wall. Ring 32 surrounds the discharge end of a channel 31 that is connected via a coupling 49 to a supply line 19 to which air from a compressor 44 can be admitted by a solenoid valve 43, line 19 being vented through a port 45 in the position of valve 43 shown in FIG. 3. A branch 21 of line 19 extends to a cylinder 20 which is fixedly secured to the block 4 and has a piston 27 with a piston rod 25 projecting into socket 22 from below, opposite sealing ring 32, piston 27 being loaded by a spring 26 seeking to retract it from the socket.

The discharge opening of channel 31 confronts in the loading position an entrance aperture of an L-shaped conduit 9 forming part of an air-inlet channel which includes a further conduit 28 separated from conduit 9 by a spring-loaded check valve 11. Conduit 28 communicates, in the loading position illustrated in FIG. 3, with a port 29 by way of an L-shaped passage 28' in the body of a control valve 12 having two positions A and B spaced 90° apart. Port 29 is connected through a tube 13 with the cylinder 33 of jack 1 whose single-acting piston 34 is held against rotation by a radial pin 40 traversing a longitudinal slot 39 in the cylinder wall. An axial bore within piston 34 receives the free end of a shaft 37 which is integral with clamp jaw 3 and rotatably journaled in the opposite end of cylinder 33, being held against axial displacement by a retaining ring or circlip 41. A restoring spring 35 in the bore of piston 34 biases the latter toward the left, resisting its displacement by compressed air admitted via valve 12 and line 13 into cylinder 33. The right-hand end of piston 34 forms a helicoidal ramp face 38 which coacts with a radial pin 36 of shaft 37 and, upon a rightward shift of the piston under air pressure, rotates the shaft together with jaw 3 through about 90° against the force of a torsion spring 42. The mobile jaw 3, upon being thus rotated, closely approaches the jaw 2 rigid with carriage 10 to clamp the workpiece 7 therebetween with a firm grip. Jaw 3 has a hook-shaped end which points downwardly toward jaw 2 in the illustrated release position but is generally parallel to the latter jaw, i.e. substantially horizontal, in the clamping position. Such a jaw has already been disclosed in a commonly owned copending application, Ser. No. 914,143, filed by me jointly with Harald Colbrunn and Heinz Fransing on June 9, 1978.

The swing of control valve 12 between its illustrated air-admitting position B and its other position A is controlled by two fixed stops 23, 24 respectively engaging a handle 14 of the valve in the loading position and in an unloading position at the opposite end of the track. When the handle is in position A, channel 28' of valve 12 connects the interior of cylinder 33 via tube 13 and port 29 to an outlet 30 for venting that cylinder to the atmosphere, thereby allowing springs 35 and 42 to return the jaw 3 to its release position.

The operation of the system shown in the drawing is as follows:

With carriage 10 in its loading position at station 50 and clamp jaws 2, 3 wide open, solenoid valve 43 is briefly energized by means of a manual switch or a photoelectric sensor, not shown, upon the placement of a workpiece 7 on the supporting table with the left-hand end of the workpiece introduced between these jaws. As the shut-off valve 43 shifts into its alternate position, air under pressure enters the channel 31 and simultaneously flows into cylinder 20 to drive the piston 27 upwardly, against the force of spring 26, in order to press the nipple 10' firmly against the sealing ring 32. A leakproof path is thus formed between channels 31 and 9, 28, allowing air under pressure to flow past check valve 11 and through control valve 12 into cylinder 33 for closing the jaws 2, 3 around the workpiece as described above. When the front end of the workpiece is inserted between presser foot 8 and feed 46, the workpiece is advanced toward the right and entrains the clamp 1–3 together with carriage 10 against the restoring force F toward work station 5. By that time the valve 43 has been reclosed so that the tip 25 of piston 27 is withdrawn from nipple 10' and no air escapes from channel 31. Moreover, the volume of compressed air previously admitted into cylinder 33 is trapped by the check valve 11 and the control valve 12 which remains in position B until the carriage 10 reaches the unloading position when the setting member 14 is swung around by its contact with stop 24 to vent the cylinder 33 and reopen the clamp. The release of the workpiece allows the counteracting force F, which may be intensified at this time as described in U.S. Pat. No. 4,102,280, to return the carriage to station 50 where stop 23 restores the illustrated position of control valve 12. It will be apparent that, with piston 27 retracted, nipple 10' can readily enter the socket 22 of block 4 to realign the entrance aperture of passage 9 with the discharge opening of channel 31. The rounded profile of sealing ring 32 also facilitates such re-entry.

Any accidental or other movement of handle 14 into position A while the carriage 10 is traveling toward station 50 with the jaw 3 released, as shown in FIGS. 1 and 2, will have not effect upon that jaw since tube 13 will not be pressurized under these conditions.

It will be understood that the clamping mechanism according to my invention may also be used for positively displacing a workpiece along a guide path such as track 15 instead of merely tensioning a fabric layer or the like entrained by other transport means such as a sewing-machine feed.

I claim:

1. A device for releasably gripping a workpiece moving between a first station and a second station, comprising:

track means extending between said first and second stations;

a carriage reciprocable along said track means;

a source of pressure fluid at said first station;

clamp means on said carriage provided with fluidically actuatable operating means, including a single-acting piston in a cylinder provided with an inlet channel communicating with said source in a loading position at said first station for closing said clamp means around a workpiece by the admission of pressure fluid;

biasing means including a restoring spring tending to hold said clamp means open, said clamp means including a first jaw rigid with said carriage and a second jaw having a shaft journaled in said cylinder for rotation about an axis generally parallel to said first jaw, said piston terminating in a ramp face coacting with a projection on said shaft for rotating the latter about said axis against the force of said restoring spring resisting such rotation; and valve means in said inlet channel settable in said loading position to maintain the pressure of the admitted fluid, said valve means including a control valve reversible in an unloading position at said second station to relieve the fluid pressure for allowing said biasing means to reopen said clamp means for releasing the engaged workpiece.

2. A device as defined in claim 1 wherein said source includes a supply line terminating in a discharge opening, said inlet channel having an entrance end confronting said discharge opening in said loading position, further comprising piston means at said first station fluidically operable to force said entrance end into fluidtight contact with said discharge opening.

3. A device as defined in claim 2 wherein said inlet channel is formed in part by a nipple extending in the direction of motion of said carriage, said entrance end being a lateral aperture in said nipple, said piston being movable transversely to said direction of motion for deflecting said nipple toward a stationary wall formed with said discharge opening.

4. A device as defined in claim 3 wherein said wall is provided with a sealing ring surrounding said discharge opening, said nipple moving past said sealing ring upon displacement of said carriage into and out of said loading position.

5. A device as defined in claim 1 wherein said valve means comprises a check valve in cascade with said control valve.

6. A device as defined in claim 5 wherein said control valve is provided with a setting member engageable with respective stops at said stations for displacement into a fluid-admitting state upon arrival of said carriage in said loading position and into a fluid-venting state upon arrival of said carriage in said unloading position.

7. A device for releasably gripping a movable workpiece, comprising:

a source of pressure fluid;

a stationary socket forming a discharge opening connected via a supply line with said source;

a carriage movable between a loading position and an unloading position;

normally open clamp means on said carriage provided with fluidically actuatable operating means having an inlet channel receivable in said socket with an entrance end confronting said discharge opening in said loading position, said inlet channel being formed in part by a nipple extending in the direction of motion of said carriage, said entrance end being a lateral aperture in said nipple; and plunger means at said socket movable transversely to said direction of motion in said loading position for deflecting said nipple toward a stationary wall formed with said discharge opening, thereby forcing said entrance end into fluidtight contact with said discharge opening for pressurizing said operating means to close said clamp means around a workpiece.

8. A device as defined in claim 7 wherein said wall is provided with a sealing ring surrounding said discharge opening, said nipple moving past said sealing ring upon displacement of said carriage into and out of said loading position.

9. A device as defined in claim 7 wherein said plunger means is a fluidically operable piston connected to said supply line.

10. A device as defined in claim 7 or 9 wherein said source comprises an air compressor provided with a shut-off valve openable only in said loading position of said carriage.

11. A device for releasably gripping a workpiece moving between a first station and a second station, comprising:

track means extending between said first and second stations;

a carriage reciprocable along said track means;

clamp means on said carriage provided with fluidically actuatable operating means;

biasing means tending to hold said clamp means open;

a source of pressure fluid at said first station including a supply line which terminates in a discharge opening, said operating means having an inlet channel formed in part by a nipple which extends in the direction of carriage motion and has a lateral aperture confronting said discharge opening in a loading position at said first station;

a piston at said first station fluidically displaceable transversely to a stationary wall provided with said discharge opening for forcing said lateral aperture into fluidtight contact with said discharge opening in said loading position to close said clamp means around a workpiece against the force of said biasing means by the admission of pressure fluid; and valve means in said inlet channel settable in said loading position to maintain the pressure of the admitted fluid, said valve means including a check valve and further including a control valve in cascade with said check valve and reversible in an unloading position at said second station to relieve the fluid pressure for allowing said biasing means to reopen said clamp means for releasing the engaged workpiece, said control valve being provided with a setting member engageable with respective stops at said stations for displacement into a fluid-admitting state upon arrival of said carriage in said loading position and into a fluid-venting state upon arrival of said carriage in said unloading position.

* * * * *